US007627923B2

(12) United States Patent
Lassalle

(10) Patent No.: US 7,627,923 B2
(45) Date of Patent: Dec. 8, 2009

(54) TOOTHBRUSH

(76) Inventor: Thomas Lassalle, 15 Allée de l'Orédu Bois, Lons (FR) F-64140

( * ) Notice: Subject to any disclaimer, the term of this patent is extended or adjusted under 35 U.S.C. 154(b) by 63 days.

(21) Appl. No.: 10/586,391

(22) PCT Filed: Mar. 2, 2005

(86) PCT No.: PCT/FR2005/000490

§ 371 (c)(1),
(2), (4) Date: Jul. 17, 2006

(87) PCT Pub. No.: WO2005/087044

PCT Pub. Date: Sep. 22, 2005

(65) Prior Publication Data

US 2007/0143944 A1 Jun. 28, 2007

(30) Foreign Application Priority Data

Mar. 2, 2004 (FR) ..... 04 02106

(51) Int. Cl.
*A46B 9/04* (2006.01)

(52) U.S. Cl. ..... 15/167.2; 15/167.1

(58) Field of Classification Search ..... 15/167.2, 15/167.1; 601/141
See application file for complete search history.

(56) References Cited

U.S. PATENT DOCUMENTS

| | | | | |
|---|---|---|---|---|
| 1,225,955 | A * | 5/1917 | Hickman | 15/167.2 |
| 2,284,200 | A * | 5/1942 | Gruss | 601/140 |
| 3,732,589 | A * | 5/1973 | Burki | 15/22.1 |
| 4,757,570 | A | 7/1988 | Haeusser et al. | |
| 6,658,686 | B1 * | 12/2003 | Lee | 15/27 |
| 2002/0152563 | A1 | 10/2002 | Sato | |
| 2003/0226224 | A1 * | 12/2003 | Lee | 15/27 |
| 2007/0143944 | A1 * | 6/2007 | Lassalle | 15/167.2 |

FOREIGN PATENT DOCUMENTS

| | | |
|---|---|---|
| GB | 2 377 167 | 1/2003 |
| WO | WO 89/01303 | 2/1989 |

* cited by examiner

*Primary Examiner*—Lee D Wilson
(74) *Attorney, Agent, or Firm*—Equinox Protection; Franz Bonsang, Patent Agent

(57) ABSTRACT

A toothbrush (1) including a handle (15) and a brushing head (2) with two brushing compartments (3, 4). The upper brushing compartment (3) is engageable by the teeth of the upper jaw and the lower brushing compartment (4) is simultaneously engageable by the teeth of the lower jaw. The handle of the invention can be pivotably mounted (16, 18) on an outer wall (17) of the brushing head.

20 Claims, 1 Drawing Sheet

TOOTHBRUSH

Figure 1:
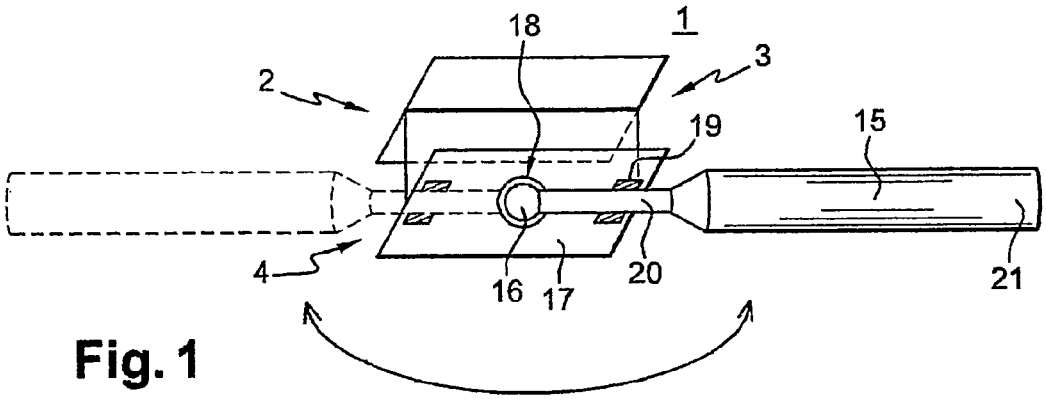

The subject of the invention is a toothbrush. More precisely, the subject of the invention is a toothbrush the brushing head of which allows simultaneous brushing of teeth on a user's lower jaw and teeth on the user's upper jaw. The subject of the invention is also a specific handle mounted pivotably on the brushing head.

One purpose of the invention is to optimize the time a user requires for brushing his teeth. Another purpose of the invention is to optimize the quality of toothbrushing.

In the state of the art a toothbrush with a handle and a simple brushing head is known. By "brushing head" is meant an end part arranged at a free end of the handle of the toothbrush and which has flexible brushing elements, such as bristles. The brushing head is simple to the extent that it only allows the teeth on the upper or lower jaw to be brushed at one time. For example, the simple brushing head has a base an upper surface of which comprises a plurality of flexible brushing elements extending radially over said base. With such a toothbrush the user has to carry out a lengthy and laborious brushing. The brushing head in fact only allows the brushing of one surface of the teeth at a time. The user must thus proceed in stages in order to clean the inside, outside and flat surfaces of the teeth, and this must be done for each jaw. Thus, for each jaw, lower and upper, it is necessary to undertake three separate back and forth movements in order to guarantee a proper brushing of the three surfaces of the teeth.

Also known in the state of the art is a simple brushing head which allows simultaneous brushing of the three surfaces of the teeth on a jaw. Such a brushing head is provided with a brushing compartment into which the user can introduce teeth of the upper or lower jaw. An inside surface of the walls forming the brushing compartment is provided with flexible brushing elements. The teeth are thus surrounded over their three surfaces with flexible brushing elements. With such a toothbrush it is however still necessary to proceed in several stages, i.e. by brushing the teeth of the upper jaw and then the lower jaw, or vice versa.

Moreover, in any case it is often necessary to remove the toothbrush from inside the oral cavity during brushing. For example, in order to move the toothbrush from a left-side part of the oral cavity to a right-side part, the toothbrush is at least partially removed from inside the oral cavity. Very often, when the toothbrush is removed from the oral cavity, foam from toothpaste used as an aid to brushing the teeth can flow out of the said oral cavity. Such a flow of foam can cause splashes. Moreover, teeth brushed subsequently will receive a poorer quality of brushing because the quantity of toothpaste used for brushing is reduced.

The invention seeks to resolve the problems described above by proposing a brushing head which is able to brush teeth on a user's lower jaw and teeth on his upper jaw simultaneously. In order to do this, the brushing head of the invention is provided with two brushing compartments fixed to a handle of the toothbrush of the invention. Each compartment is able to receive teeth situated respectively on the upper jaw and the lower jaw of the user. The compartments are provided, on their internal surfaces, i.e. the surfaces facing the teeth, with flexible brushing elements. The teeth accommodated in the compartments are brushed on their three surfaces, i.e. the inside surface, the outside surface and the flat surface, at the same time. The two compartments are for example firmly attached to each other at a base point, in such a way that an opening of each of the compartments is orientated respectively upwards and downwards. The user can thus simultaneously brush teeth situated on the lower jaw and teeth situated opposite them on the upper jaw. Moreover, in a particular embodiment of the invention, the handle can be mounted pivotably on an external wall of the brushing head. When a first side, left or right, of the oral cavity is brushed, the user has only to turn the handle by a simple pivot movement from a first position, left or right on the brushing head, to a second opposite position on the said brushing head. It is then possible for the user to brush teeth situated on the opposite part of the oral cavity, which are not yet brushed, without having had to remove the toothbrush from, and reintroduce it into, the oral cavity. The user moves the toothbrush in a semi-circular motion following a curve of his dentition so as to move the toothbrush from one side of the oral cavity to the other. In order to optimize contact between the brushing elements and the teeth, it can be envisaged that the brushing head is curved inwards so as to follow the curve of the dentition. With the toothbrush of the invention, it is therefore possible to brush all the teeth of the upper and lower jaws of the user in one go.

The subject of the invention is therefore a toothbrush comprising a handle and a brushing head, characterized in that the brushing head comprises two brushing compartments, an upper brushing compartment which is able to receive teeth of the upper jaw and a lower brushing compartment which is simultaneously able to receive teeth of the lower jaw.

In a particular example of the invention, the handle is mounted pivotably on an external wall of the brushing head.

The toothbrush of the invention may also comprise all or some of the following characteristics:

- the upper brushing compartment and the lower brushing compartment are firmly attached to each other;
- the brushing head is generally H-shaped, the upper brushing compartment forming the upper part of the H shape and the lower brushing compartment forming the lower part of the H shape;
- internal walls of the upper and lower brushing compartments are provided with flexible brushing elements which extend radially over the internal walls;
- the brushing head is curved inwards;
- the brushing head is detachable;
- the external wall of the brushing head is provided with at least one means for attaching the handle to the said external wall;
- the external wall of the brushing head is provided with two means of fastening which are able to hold the handle in two stable and opposite positions;
- the toothbrush is electric.

Figure 2:
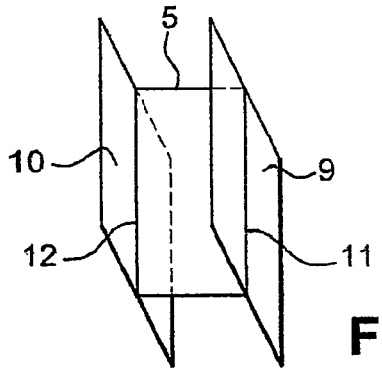
Figure 4:
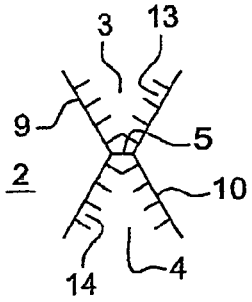
Figure 3:
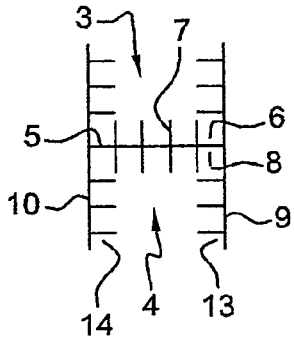

The invention will be better understood through reading the following description and examining the attached figures. These are given by way of example and in no way limit the invention. The figures show:

FIG. 1: a side view of a toothbrush according to an embodiment of the invention;

FIG. 2: a top view of a brushing head of the invention:

FIG. 3: a cross section of a brushing head according to an embodiment of the invention;

FIG. 4: a cross section of a brushing head according to another embodiment of the invention.

FIG. 1 shows a view of one embodiment of a toothbrush 1 of the invention. A brushing head 2 of the toothbrush 1 is provided with a first compartment 3, or upper compartment and a second compartment 4, or lower compartment. The upper compartment 3 is able to receive teeth situated on the user's upper jaw. The lower compartment 4 is able to receive teeth situated on the user's lower jaw and arranged opposite the teeth accommodated in the upper compartment 3.

FIG. 3 shows a cross-section of the brushing head 2 according to one embodiment of the invention. The brushing head 2 is generally H-shaped. The brushing head 2 is provided with a base 5, forming a horizontal bar of the H, of which an upper surface 6 is provided with flexible brushing elements 7 extending radially over the said upper surface 6. Similarly, a lower surface 8 of the base 5 is provided with flexible brushing elements 7 extending radially over the said lower surface 8. The base 5 is provided with two walls 9 and 10 extending radially on two edges 11 and 12 of the base 5 (FIG. 2) and forming two vertical bars of the H. The walls 9 and 10 are parallel to each other. The wall 9 and the wall 10 project upwards and downwards with respect to the base 5. Thus, the base 5 and the walls 9 and 10 form the upper compartment 3 and lower compartment 4 of the brushing head 2. The brushing elements 7 arranged on the internal surfaces of the walls 9 and 10 and the base 5 allow simultaneous brushing of the three surfaces of the teeth accommodated in the upper compartment 3 and the lower compartment 4 of the brushing head 2.

In another embodiment of the invention as represented in FIG. 4, the upper compartment 3 and lower compartment 4 each form a right-facing and left-facing V-shape respectively. The two compartments are connected together at the point where they meet their common base 5. Such a brushing head 2 may be particularly suitable for brushing the teeth of a young child. In fact, young children have no molars which have a rectangular section. The teeth of young children, i.e. principally the canines and incisors, have a triangular section, for which the brushing head 2 as represented in FIG. 4 may be more suitable.

As represented in FIGS. 3 and 4, each wall 9 and 10 is provided on an internal surface, 13 and 14 respectively, with flexible brushing elements 7, extending radially over the said internal surface 13 or 14.

In the invention, the toothbrush 1 also comprises a handle for grip and manipulation. The handle 15 is mounted pivotably using a pivot 16, on an external surface 17 of one or other of the walls 9 or 10 of the brushing head 2 (FIG. 1). For example, the pivot 16 is housed in a seat 18 provided on the external surface 17 of the wall 9 of the brushing head 2; the seat 18 being approximately centered on the external surface 17 of the wall 9. Thus the handle 15 may swing between two opposing stable positions, handle 15 to the right or to the left in FIG. 1, in which the said handle extends in a plane parallel to the plane of the wall 9.

In order to maintain the handle 15 in one or other of these two stable opposite positions, the external surface 17 of the wall 9 can be provided with fastening means 19 for the handle 15. For example, the fastening means 19 are formed by a circlip which allows a distal end 20 of the handle 15 to lock onto the wall 17. Thus the external surface 17 is provided with two circlips situated at opposite edges of the said external surface, each circlip allowing the handle 15 to be maintained in one or other of the stable positions depending on the requirements of the user.

In another embodiment of the invention (not represented), the fastening means 19 are for example provided by a recess and two projections. Thus a cylindrical recess can be produced on the distal part 20 of the handle 15, with two cylindrical protuberances projecting from the external surface 17. Each projection is situated on an opposite edge of the external surface 17, and is designed to be housed in the cylindrical recess provided on the distal part 20 of the handle 15.

It is also possible to envisage fastening means which allow the handle 15 to be maintained in a plane perpendicular to the plane containing the brushing head 2. Such a stable third position may for example allow the toothbrush 1 to be stored more easily in a glass. In fact, the brushing head 2 is not at risk of pressing against the inside of the glass. Similarly, a proximal end 21 of the handle 15 may be envisaged with a base (not represented). The base allows the user to rest the toothbrush 1 on a flat surface after use. When the handle 15 is maintained in its third stable position, it is not at risk of swinging due to gravity, contrary to the possible effect if the handle 15 was maintained in a plane parallel to the plane containing the brushing head 2.

The handle 15 may also be mounted firmly on the brushing head 2. In this case, the handle 15 extends in a plane parallel to the plane containing the brushing head 2. Then in order to brush both sides of the oral cavity, the user must withdraw the teeth first cleaned from compartments 3 and 4 in order to exert a swinging movement on the toothbrush 1, in order to bring the brushing head 2 onto the opposite side of the oral cavity and proceed to brush the teeth situated on this opposite side.

In the particular embodiment of the invention, it is possible to produce the brushing head 2 so that it is detachable. That is to say, it is possible to detach the brushing head 2 from the handle 15. For example, the pivot 16 is simply removed from the seat 18, so that the brushing head 2 is independent of the handle 15. Such a solution means that only the brushing head 2 need be changed when for example the brushing head 2 is unusable due to wear on the brushing elements 7. Similarly, such a solution allows a single handle 15 to be used for different brushing heads 2.

In another embodiment, it is possible to produce two independent compartments, a lower compartment 3 and an upper compartment 4. Thus the handle 15 holding the brushing head 2 is divided into two rods at the location of the distal end 20. Each rod is firmly fixed to a compartment 3 or 4 of the brushing head 2. A distance between the two rods is calculated in such a way as to allow the teeth to be brushed without the user having to open their jaws too wide. It is also possible to produce the handle 15 in such a way that the rods are flexible. Thus the distance between the two rods and therefore between the two compartments 3 and 4 may vary. Such a handle 15 allows a toothbrush 1 to be produced which is suitable for oral cavities of all sizes.

The brushing heads 2 may also be varied according to the size of users oral cavities. It is a fact that the oral cavity of an adult is larger than that of a child, in particular as a result of the increasing number of teeth. Thus the base 5 and the walls 9 and 10 of the brushing head 2 of a toothbrush 1 may be of different dimensions for an adult and for a child, such that they are suitable for the user in question.

The invention claimed is:

1. A toothbrush, comprising:

a brushing head, with i) a first side portion (9) having a first length, ii) a second side portion (10) facing said first side portion, having a second length, iii) a planar joining portion (5), having a third length, joining a midsection of the first side portion to a midsection of the second side portion along the third length, iv) a first brushing compartment over a top surface of said joining portion and between an internal surface of said first side portion and an internal surface of said second side portion, and v) a second brushing compartment under a bottom surface of said joining portion and between the internal surface of said first side portion and the internal surface of said second side portion;

flexible brushing elements extending from the internal surfaces of both the upper brushing compartment and the lower brushing compartment; and a handle mounted pivotably between i) a first position at an external surface of said first side portion and ii) an opposite, second position at an external surface of said first side portion, so that the handle swings between the first and second opposite stable positions.

2. The toothbrush according to claim 1, further comprising:

a first fastening means located on the external surface of said first side portion to releasably and stably fasten the handle in the first position; and a second fastening means located on the external surface of said first side portion to releasably and stably fasten the handle in the second position.

3. The toothbrush according to claim 2, wherein, the external surface of the brushing head is provided with a fastening means for releasably fastening the handle in a position about the axis in alignment with the third length of the joining portion, and the handle fastened by the fastening means extends coplanar to the external surface.

4. The toothbrush according to claim 1, wherein the handle is pivotably movable in a plane substantially perpendicular to a plane of the external surface.

5. A toothbrush, comprising:

a brushing head, with, a first brushing compartment, having an internal planar first surface, an internal planar second surface facing opposite the first surface, and a first planar connecting surface joining the first surface to the second surface, the first surface, the second surface, and the first connecting surface enclosing a first space on three sides with a first open end opposite the first connecting surface, a second brushing compartment, having an internal planar third surface, and internal planar fourth surface facing opposite the third surface, and a second planar connecting surface joining the third surface to the fourth surface, the third surface, the fourth surface, and the second connecting surface enclosing a second space on three sides with a second open end opposite the second connecting surface, the first open end facing opposite the second open end;

brushing elements extending from each of the surfaces of the first brushing compartment and the second brushing compartment; and a handle portion connected to an external of surface of at least one of the first brushing compartment and the second brushing compartment.

6. The toothbrush according to claim 5, wherein the handle portion is pivotably movable in a plane substantially perpendicular to a plane of the external surface.

7. A toothbrush comprising:

a brushing head (2), comprising an upper brushing compartment (3) configured to receive the teeth of an upper jaw, and a lower brushing compartment (4) configured to simultaneously receive the teeth of a lower jaw, the upper and lower brushing compartments (3, 4) being defined by external side walls (9, 10) and being separated from one another by a base wall (5) extending between the side walls intermediate upper and lower ends thereof, the side walls and the base wall being provided with flexible brushing elements extending inwardly from the respective walls into the compartments; and a handle (15) mounted externally and pivotably on one of the side walls (9) of the brushing head (2) intermediate the side wall upper and lower ends and extending away from the brushing head (2), wherein the handle is pivotably moveable in a plane parallel to a plane of the base wall (5).

8. The toothbrush according to claim 7, wherein the upper brushing compartment (3) and the lower brushing compartment (4) are firmly attached to each other.

9. The toothbrush according to claim 7, wherein the brushing head (2) is generally H-shaped, with the upper brushing compartment (3) forming an upper part of the H-shape and the lower brushing compartment (4) forming a lower part of the H-shape.

10. The toothbrush according to claim 7, wherein the upper and lower brushing compartments (3, 4) are each generally V-shaped.

11. The toothbrush according to claim 7, wherein the brushing head (2) is curved.

12. The toothbrush according to claim 7, wherein the brushing head (2) is detachable.

13. The toothbrush according to claim 7, wherein the external wall (9) of the brushing head (2) is provided with at least one fastening means for releasably fastening the handle in at least one stable position onto the external wall.

14. The toothbrush according to claim 7, wherein the external wall of the brushing head is provided with two fastening mean for releasably fastening the handle in either one of two stable and opposite positions.

15. The toothbrush according to claim 7, wherein the toothbrush is electric.

16. The toothbrush according to claim 7, wherein the handle (15) is pivotably mountable (16, 18) on a pivot member (16) on an external surface (17) of the external wall (9) of the brushing head (2), the external surface further comprising a seat (18) for housing the pivot member.

17. The toothbrush according to claim 7, wherein the handle (15) is mounted pivotably on the external wall (9) of the brushing head (2) at a first end of the handle (15), the first hand of the handle (15) being rotatably mounted to a pivot member (16) located on an external surface (17) of the external wall (9) of the brushing head (2), the handle being pivotable between i) a stable first mounting position where, during use, a portion of the handle overlays a first end of the external surface of the external wall of the brushing head, and ii) a stable second mounting position which is opposite the stable first mounting position, where, during use, a portion of the handle overlays a second end of the external surface of the external wall of the brushing head, and wherein the handle extends in a plane substantial parallel to the plane of the external wall when in either of the first and second mounting positions.

18. The toothbrush according to claim 17, wherein the pivot member (16) is located substantially centrally on the external surface (17) of the external wall (9) of the brushing head (2).

19. The toothbrush according to claim 17, further comprising:

a first fastening means located on the external surface of the external wall (9) at the first end of the external wall (9), configured to releasably fasten the handle in the stable first mounting position; and a second fastening means, located on the external surface of the external wall at the second end of the external wall and configured to releasably fasten the handle in the stable second mounting position.

20. The toothbrush according to claim 7, wherein the brushing head is generally H-shaped, with the upper brushing compartment forming an upper part of the H-shape and the lower brushing compartment forming a lower part of the H-shape.

* * * * *